US006696790B2

(12) United States Patent
Murao et al.

(10) Patent No.: US 6,696,790 B2
(45) Date of Patent: Feb. 24, 2004

(54) MAGNETRON WITH EXTERNAL TERMINALS HAVING CONNECTING PORTIONS WHICH ARE AIR-TIGHTLY CONNECTED TO CATHODE LEADS

(75) Inventors: Noriyuki Murao, Hyogo-ken (JP); Kazuki Miki, Himeji (JP); Setsuo Hasegawa, Nishiwaki (JP); Noriyuki Okada, Hyogo-ken (JP); Satoshi Nakai, Kasai (JP)

(73) Assignee: Sanyo Electric Co., Ltd., Osaku-Fu (JP)

( * ) Notice: Subject to any disclaimer, the term of this patent is extended or adjusted under 35 U.S.C. 154(b) by 0 days.

(21) Appl. No.: 10/154,809

(22) Filed: May 28, 2002

(65) Prior Publication Data

US 2002/0180363 A1 Dec. 5, 2002

(30) Foreign Application Priority Data

May 30, 2001 (JP) ..... 2001-161878

(51) Int. Cl.[7] ..... H01J 25/50

(52) U.S. Cl. ..... 315/39.51; 313/36; 313/38; 313/42

(58) Field of Search ..... 315/39.51, 39.53, 315/39.67, 39.71; 313/34, 36, 37, 38, 42, 43

(56) References Cited

U.S. PATENT DOCUMENTS 5,604,405 A * 2/1997 Ogura ..... 315/39.51

6,351,071 B1 * 2/2002 Itoh ..... 315/39.51

FOREIGN PATENT DOCUMENTS

| | | |
|---|---|---|
| JP | 55-49843 | 4/1980 |
| JP | 55-105929 | 8/1980 |
| JP | 55-108140 | 8/1980 |
| JP | 63-10429 | 1/1988 |
| JP | 63-138625 | 6/1988 |
| JP | 64-31330 | 2/1989 |
| JP | 3-74028 | 3/1991 |
| JP | 4-32133 | 2/1992 |

* cited by examiner

*Primary Examiner*—Haissa Philogene
(74) *Attorney, Agent, or Firm*—Sughrue Mion, PLLC

(57) ABSTRACT

A magnetron including a tubular metallic container which is air-tightly connected to an anode, cathode leads for supporting a cathode with filaments being disposed in a central axial portion of the anode, a stem insulator formed with through holes through which the cathode leads pass, and external terminals formed with planar portions which are air-tightly connected to a surface of the stem insulator opposite to a surface facing the tubular metallic container and with connecting portions which are air-tightly connected to the cathode leads. The connecting portions are arranged to be bent in an axial direction of the cathode leads. It is possible to exhibit the effect of preventing vacuum break from occurring by oxidation or the like since the increase in the area of the connecting portions will result in elongation of the distance between the end portions of the connecting portions and the through holes.

2 Claims, 3 Drawing Sheets

MAGNETRON WITH EXTERNAL TERMINALS HAVING CONNECTING PORTIONS WHICH ARE AIR-TIGHTLY CONNECTED TO CATHODE LEADS

BACKGROUND OF THE INVENTION

The present invention relates to a magnetron which is equipped in a microwave oven or the like for generating microwaves.

A conventional cathode arrangement of a magnetron for use in a microwave oven as described, for instance, in Japanese Unexamined Patent Publication No. 46732/1991 (HO1J 23/05) is such that a pair of cathode leads for supporting a cathode pierce through through holes of a stem insulator whereupon they are fixedly attached to the stem insulator via external terminals by brazing. The external terminals not only function as electrodes for energizing the cathode but also serve as vacuum sealing parts for airtight connection with the stem insulator. While a generally employed material for the cathode leads is molybdenum having a high melting point and a high hardness, in case molybdenum is to be brazed with a metallic alloy or the like, a brazing material will not uniformly flow to portions at which molybdenum contacts with the metallic alloy, so that the brazing performance is improved by plating the molybdenum surface contacting with the external terminals with nickel or the like.

However, since connection between the external terminals and the cathode leads is achieved only on a section in thickness direction of the material for the external terminals in such an arrangement of a magnetron, the contacting area will be extremely small, so that there were presented drawbacks that through holes were generated through progression of oxidation of the brazing material and that vacuum break was caused at an early stage at connecting portions between the cathode leads and the external terminals.

SUMMARY OF THE INVENTION

It is an object of the present invention to provide a magnetron of high reliability in which vacuum break does hardly occur at connecting portions between the cathode leads and the external terminals.

In accordance with present invention, there is provided a magnetron including a tubular metallic container which is air-tightly connected to an anode to define a part of a vacuum container, cathode leads for supporting a cathode with filaments being disposed in a central axial portion of the anode, a stem insulator formed with through holes through which the cathode leads pass, an open end portion of the tubular metallic container being air-tightly connected to circumference of the stem insulator, and external terminals formed with planar portions which are air-tightly connected to a surface of the stem insulator opposite to a surface facing the tubular metallic container and with connecting portions which are air-tightly connected to the cathode leads. The connecting portions are arranged to be bent in an axial direction of the cathode leads.

According to the above arrangement, the connecting portions are bent in the axial direction of the cathode leads, areas at which the connecting portions and the cathode leads contact with each other are increased. Accordingly, even though oxidation of the air-tightly connected portions is progressed, the distance from end portions of the connecting portions to the through holes through which the cathode leads pass becomes long, so that it is possible to prevent vacuum break caused by oxidation or the like.

Since the connecting portions are so arranged that the cathode leads pierce through cylindrical portions formed on the external terminals to cover an outer periphery of the cathode leads to achieve an air-tight connection between the cylindrical portions and the cathode leads by brazing, the brazed portions between the cathode leads and the external terminals can prevent vacuum break caused by oxidation or the like of the brazing material since the brazed areas in the axial direction of the cathode leads is increased by the cylindrical portions and the distance from the end portions of the cylindrical portions to the through holes is elongated.

Since the cylindrical portions are characterized by covering the end portions of the cathode leads, the brazed portions between the cathode leads and the external terminals are brazed with the brazed areas in the axial direction of the cathode leads being increased and the end portions of the cathode leads being covered by the cylindrical portions. Accordingly, the melted brazing material will not be exposed to the surface, so that it is possible to delay progression of oxidation of the brazing material and thus to prevent vacuum break from occurring at an early stage.

Further, since the cylindrical portions are characterized by being inserted into the interior of the stem insulator, the cathode leads and the cylindrical portions are brazed in the interior of the stem insulator. Accordingly, it will not be necessary to make the cathode leads project from the stem insulator, so that the cathode leads are allowed to be short to thereby reduce manufacturing costs.

Since annular concave portions into which the cylindrical portions are inserted are formed on the stem insulator, the cylindrical portions is supported between the outer peripheral surface of the cathode leads and the wall surface of the annular concave portions, to thereby reliably braze the cylindrical portions and the cathode leads.

Moreover, the cathode leads are so designed that at least a material for forming the portions which are air-tightly connected with the connecting portions is molybdenum. In case molybdenum is brazed with metallic alloy, it has been conventionally required to provide a metallic layer of nickel plating or the like on the surface of the molybdenum since the brazing material could not uniformly flow to portions at which the molybdenum and metallic alloy are contacted. The increase in connecting area in the above arrangement, however, permits brazing without providing a metallic layer on the surface of the molybdenum which is air-tightly connected to the connecting portions, thereby to achieve cuts in costs, involving no costs for providing metallic layers.

DETAILED DESCRIPTION

A first embodiment of the present invention will now be explained in details with reference to the drawings.

Figure 1:
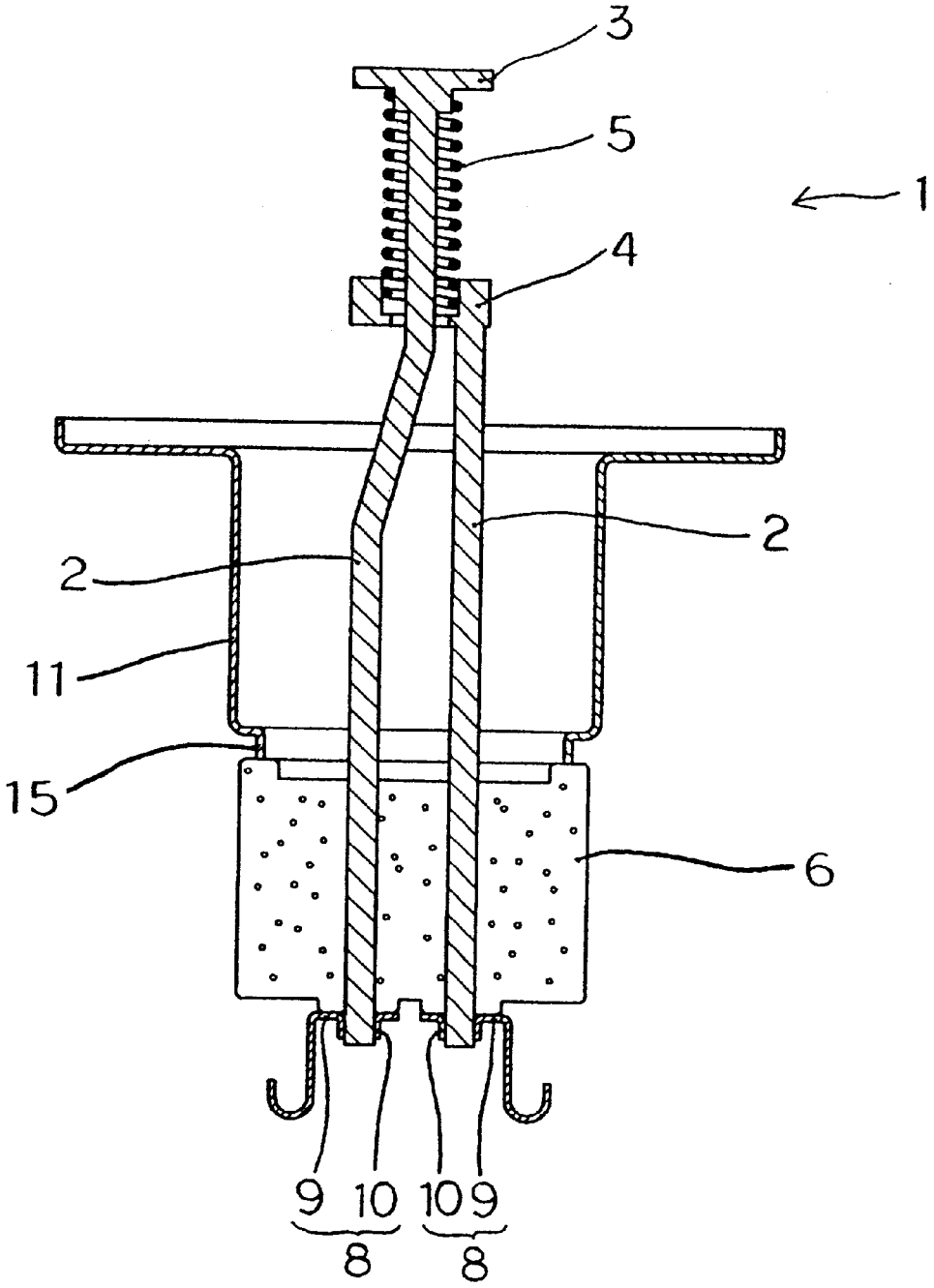
FIG. 1 is a longitudinal sectional view of a main portion of a magnetron according to a first embodiment of the present invention.
Figure 2:
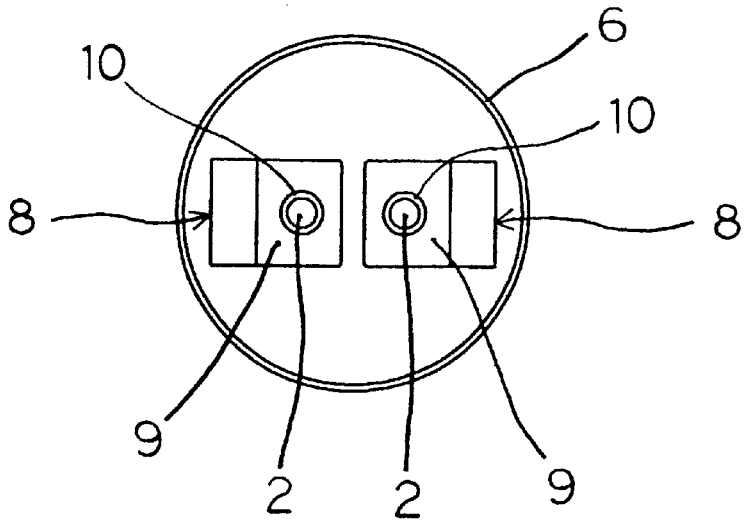
FIG. 2 is a plan view of the main portion of FIG. 1.
Figure 3:
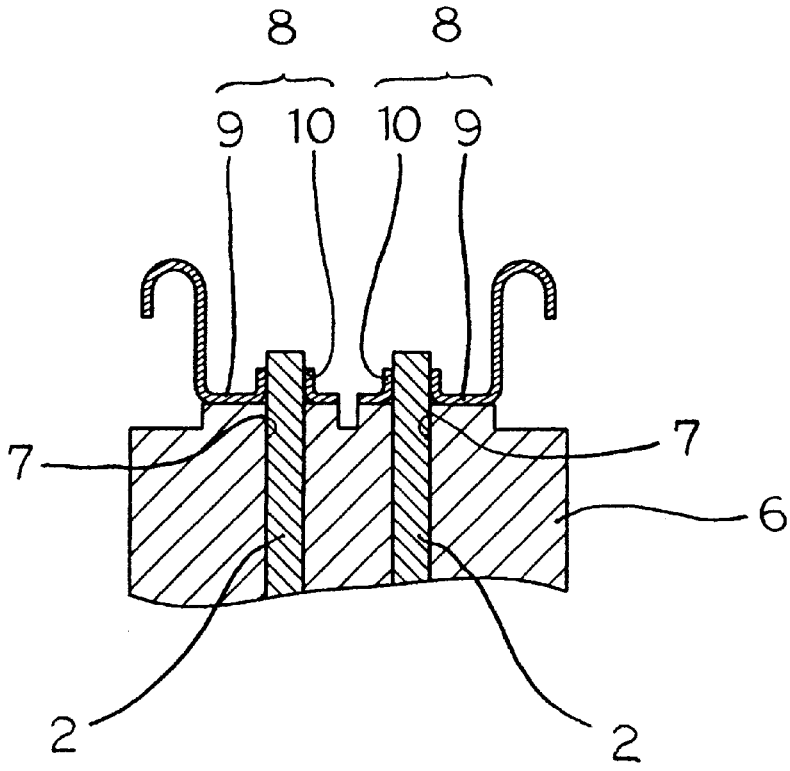
FIG. 3 is an enlarged sectional view illustrating the main portion of FIG. 1.

FIG. 1 is a longitudinal sectional view of a main portion of the magnetron according to the first embodiment of the present invention, FIG. 2 is a plan view of the main portion of FIG. 1, and FIG. 3 is an enlarged sectional view illustrating the main portion of FIG. 1.

Reference numeral 1 denotes a cathode including filaments 5 supported between both end portions of a pair of cathode leads 2 through a top hat 3 and an end hat 4, wherein thermoelectrons are radiated from the filaments 5 upon supply of current from external terminals 8 described later to the cathode 1. Since the temperature of the filaments 5 at this time is approximately 1,800° C. and thus high, molybdenum which is of high melting point and of high hardness is employed as a material for forming the top hat 3, the end hat 4 and the cathode leads 2.

Reference numeral 6 denotes a highly thermostable stem insulator made of alumina ceramics or the like, wherein the cathode leads 2 pierce through a pair of through holes 7.

Reference numerals 8 denote external terminals made of metallic alloy and the like, each external terminal 8 including planar portions 9 and cylindrical portions 10 which have been bent from the planar portions 9, wherein the planar portions 9 are air-tightly connected to the stem insulator 6 through brazing onto a surface opposite to a surface facing a cylindrical metallic container 11 described later, and the cylindrical portions 10 are air-tightly connected such that the cathode leads 2 pierce through the cylindrical portions 10 and the cathode leads 2 are brazed at the piercing portions thereof. With this arrangement, the connecting portions between the planar portions 9 and the stem insulator 6 and the connecting portions between the cathode leads 2 and the cylindrical portions 10 are respectively air-tightly connected by brazing, so that it is possible to seal the same from entrance of external air and to supply power to the cathode 1 through the external terminals 8.

While it was conventionally required to provide a metallic layer of nickel plating or the like on the surface of the molybdenum when performing brazing of molybdenum to a metallic alloy since the brazing material could not uniformly flow to portions at which the molybdenum and metallic alloy were contacted, the present embodiment is arranged such that no metallic layer is provided on the surface of the cathode leads 2 formed of molybdenum. This is because brazing has been made possible by the increase in brazed area between the cylindrical portions 10 and the cathode leads 2 even if brazing material is difficult to flow in some degree.

Reference numeral 11 denotes a cylindrical metallic container which is air-tightly connected to an anode portion 9 (not shown) and forming a part of the vacuum container, wherein an open end portion 15 of the cylindrical metallic container 11 is formed in a form of an edge and is air-tightly connected to the outer peripheral edge of the stem insulator 6 on the cathode 1 side by brazing.

According to the above arrangement, even if the brazing material is oxidized at the brazed portions between the cylindrical portions 10 of the external terminals 8 and the cathode leads 2 in actual use, since the brazed area between the cylindrical portions 10 and the cathode leads 2 has been increased in the axial direction of the cathode leads 2, the distance from upper portion of the cylindrical portions 10 to the through holes 7 has been elongated, to thereby prevent vacuum break from occurring at an early stage. Since it is further possible to perform brazing without providing a metallic layer on the surface of the cathode leads 2 which are formed of molybdenum, it is possible to achieve cuts in costs, involving no costs for providing metallic layers.

Next, the second embodiment of the present invention will now be explained with reference to the drawings. It is noted that arrangements which are identical to those of the above-described first embodiment are marked with identical reference numerals and explanations thereof will be omitted.

Figure 4:
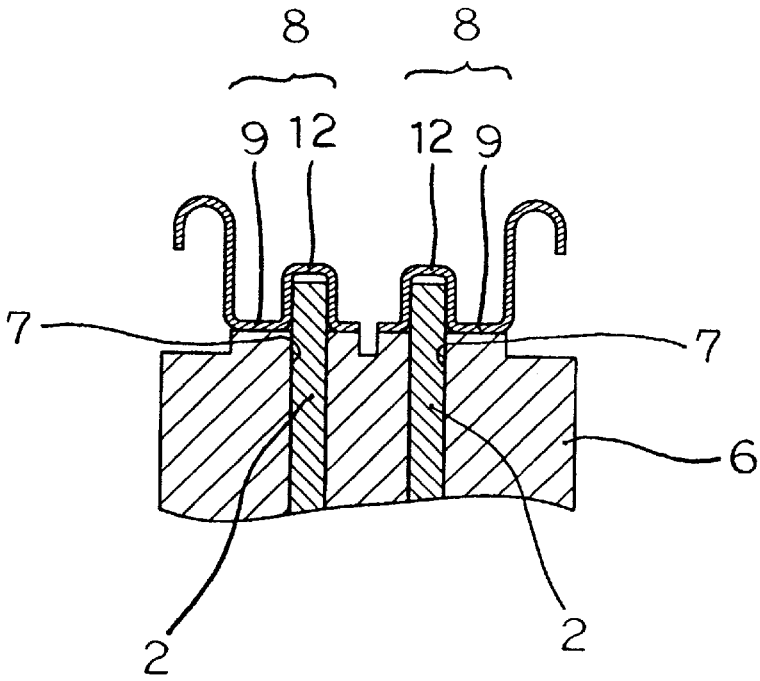
FIG. 4 is an enlarged sectional view illustrating a main portion of a second embodiment of the present invention.

FIG. 4 is an enlarged sectional view illustrating a main portion of the second embodiment of the present invention.

Reference numerals 12 denote cylindrical portions formed in a cylindrical form by being bent from planar portions 9 of the external terminals 8, wherein the cylindrical portions 12 are air-tightly connected to the cathode leads 2 through brazing so as to cover end portions of the cathode leads 2. In addition, by increasing the brazed area between the cylindrical portions 12 and the cathode leads 2, there can be realized an arrangement in which brazing can be performed without providing a metallic layer of nickel plating or the like on the surface of the cathode leads 2 formed of molybdenum.

With this arrangement, the brazed portions between the cathode leads 2 and the cylindrical portions 12 are such that not only the brazed area is increased in the axial direction of the cathode leads 2 but also brazing is performed with the end portions of the cathode leads 2 being covered by the cylindrical portions 12, so that no melted brazing material is exposed to the surface and it is accordingly possible to delay progression of oxidation of the brazing material in actual use, to thereby prevent vacuum brake from occurring at an early stage. Moreover, since it is possible to perform brazing without providing a metallic layer on the surface of the cathode leads 2 formed of molybdenum, it is possible to achieve cuts in costs, involving no costs for providing metallic layers.

The third embodiment of the present invention will now be explained on the basis of the drawings. It is noted that arrangements that are identical to those of the above-described first embodiment are marked with identical reference numerals and explanations thereof will be omitted.

Figure 5:
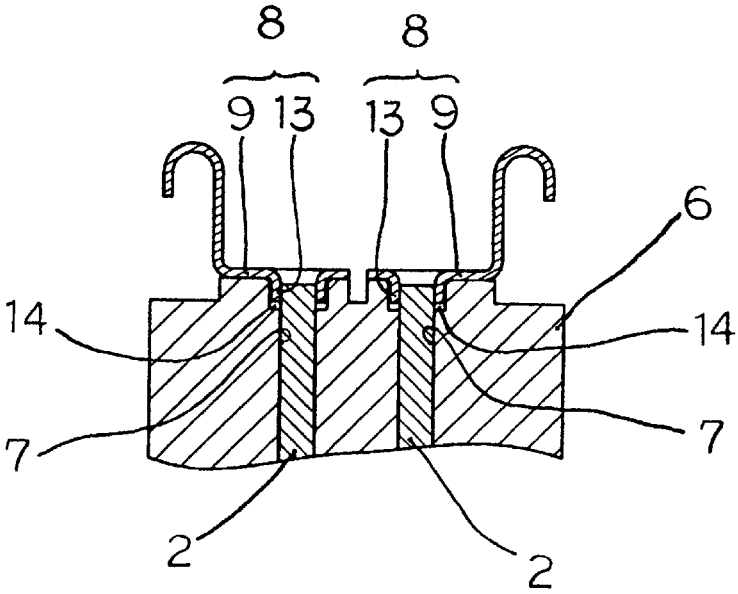
FIG. 5 is an enlarged sectional view illustrating a main portion of a third embodiment of the present invention

FIG. 5 is an enlarged sectional view illustrating a main portion of the third embodiment of the present invention.

Reference numeral 13 denotes cylindrical portions which are formed by being bent from the planar portions 9 of the external terminals 8 and which are inserted into annular concave portions 14 of the stem insulator, wherein the cylindrical portions 13 are supported between the annular concave portions 14 and the cathode leads 2. Since the cylindrical portions 13 are inserted into the interior of the stem insulator 6, the cathode leads 2 are air-tightly connected to the cylindrical portions 13 by brazing without projecting from upper portion of the stem insulator 6. Because of increase in the brazed area in the axial direction of the cathode leads 2 by the cylindrical portions 13, there can be realized an arrangement in which brazing is enabled without providing a metallic layer of nickel plating or the like on the surface of the cathode leads 2 formed of molybdenum.

According to the above arrangement, even if the brazing material is oxidized at the brazed portions between the cylindrical portions 13 of the external terminals 8 and the cathode leads 2 in actual use, since the area to be brazed by the cylindrical portions 13 is increased in the axial direction of the cathode leads 2, the distance from the end portions of the cathode leads 2 to the through holes 7 is elongated, to thereby prevent vacuum break from occurring at an early stage.

Moreover, since the cylindrical portions 13 are inserted into the interior of the stem insulator 6, the cathode leads 2 is brazed with the cylindrical portions 13 without projecting out from upper portion of the stem insulator 6, so that it is possible to arrange the cathode leads 2 to be short and thus to reduce manufacturing costs when using costly molybdenum.

Since annular concave portion 14 into which the cylindrical portions 13 are to be inserted are further formed in the stem insulator 6, the cylindrical portions 13 are supported between the outer peripheral surface of the cathode leads 2 and the wall surface of the annular concave portions 14, so that it is possible to reliably perform brazing of the cylindrical portions 13 and the cathode leads 2.

Since it is further possible to perform brazing without providing a metallic layer on the surface of the cathode leads 2 which are formed of molybdenum, it is possible to achieve cuts in costs, involving no costs for providing metallic layers.

According to the first aspect of the present invention, the magnetron includes external terminals formed with planar portions which are air-tightly connected to the stem insulator on a surface opposite to a surface facing the tubular metallic container and with connecting portions which are air-tightly connected with cathode leads, wherein the connecting portions are arranged to be bent in an axial direction of the cathode leads, it is possible to exhibit the effect of preventing vacuum break from occurring by oxidation or the like since the increase in the area of the connecting portions will result in elongation of the distance between the end portions of the connecting portions and the through holes through which the cathode leads pierce even though the connecting portions of the external terminals and the connecting portions of cathode leads are oxidized.

According to the second aspect of the present invention, the connecting portions are so arranged that the cathode leads pierce through cylindrical portions covering the outer periphery of the cathode leads formed at the external terminals and that the cylindrical portions and the cathode leads are air-tightly connected by brazing, the brazed portions between the cathode leads and the external terminals are such that the brazed area is increased by the cylindrical portions to thereby elongate the distance between the end portions of the cylindrical portions and the through holes, and it is possible to exhibit the effect of preventing occurrence of vacuum break through oxidation of the brazing material at an early stage.

According to the third aspect of the present invention, the cylindrical portions are so arranged as to cover the end portions of the cathode leads such that not only the brazed area between the cathode leads and the external terminals is increased but also brazing is performed upon covering the end portions of the cathode leads by the concave portions, no melted brazing material will be exposed to the surface, and it is accordingly possible to exhibit the effect of delaying progression of oxidation of the brazing material to prevent occurrence of vacuum break through oxidation of the brazing material at an early stage.

According to the fourth aspect of the present invention, the cylindrical portions are so arranged as to be inserted into the interior of the stem insulator, so that the cathode leads and the cylindrical portions are brazed in the interior of the stem insulator without projecting the cathode leads from the stem insulator to accordingly enable shortening of the cathode leads, and it is possible to exhibit the effect of achieving cuts in manufacturing costs.

According to the fifth aspect of the present invention, annular concave portions are formed in the stem insulator into which the cylindrical portions are inserted, the cylindrical portions are supported between the outer peripheral surface of the cathode leads and the wall surface of the annular concave portions, so that it is possible to exhibit the effect of enabling reliable brazing of the cylindrical portions and the cathode leads.

According to the sixth aspect of the present invention, the material of at least portions of the cathode leads which are air-tightly connected with the connecting portions are formed is molybdenum, it is possible to exhibit the effect of achieving cuts in manufacturing costs without involving costs for providing a metallic layer.

What is claimed is:

1. A magnetron comprising a tubular metallic container which is air-tightly connected to an anode to define a part of a vacuum container, cathode leads for supporting a cathode with filaments being disposed in a central axial portion of the anode, a stem insulator formed with through holes through which the cathode leads pass, an open end portion of the tubular metallic container being air-tightly connected to circumference of the stem insulator, and external terminals having planar portions which are air-tightly connected to a surface of the stem insulator opposite to a surface facing the tubular metallic container and connecting portions which are air-tightly connected to the cathode leads, wherein the connecting portions comprise cylindrical portions formed on the external terminals for covering axial and transverse end portions of the cathode leads, the end portions of the cathode leads being inserted into the cylindrical portions to achieve an air-tight connection between the cylindrical portions and the cathode leads by brazing.

2. A magnetron comprising a tubular metallic container which is air-tightly connected to an anode to define a part of a vacuum container, cathode leads for supporting a cathode with filaments being disposed in a central axial portion of the anode, a stem insulator formed with through holes through which the cathode leads pass, an open end portion of the tubular metallic container being air-tightly connected to circumference of the stem insulator, and external terminals having planar portions which are air-tightly connected to a surface of the stem insulator opposite to a surface facing the tubular metallic container and connecting portions which are air-tightly connected to the cathode leads, wherein the connecting portions comprise cylindrical portions formed on the external terminals for covering axial end portions of the cathode leads, the cylindrical portions being inserted into annular concave portions formed on the stem insulator to achieve an air-tight connection between the cylindrical portions and the cathode leads by brazing.

* * * * *